US009085874B2

(12) United States Patent
Saito

(10) Patent No.: US 9,085,874 B2
(45) Date of Patent: Jul. 21, 2015

(54) WORKING VEHICLE AND HYDRAULIC FLUID AMOUNT CONTROL METHOD FOR WORKING VEHICLE

(75) Inventor: Yoshiaki Saito, Mooka (JP)

(73) Assignee: KOMATSU LTD., Tokyo (JP)

( * ) Notice: Subject to any disclaimer, the term of this patent is extended or adjusted under 35 U.S.C. 154(b) by 1573 days.

(21) Appl. No.: 12/452,898

(22) PCT Filed: Jul. 22, 2008

(86) PCT No.: PCT/JP2008/063122

§ 371 (c)(1),
(2), (4) Date: Jan. 28, 2010

(87) PCT Pub. No.: WO2009/019974

PCT Pub. Date: Feb. 12, 2009

(65) Prior Publication Data

US 2010/0131158 A1 May 27, 2010

(30) Foreign Application Priority Data

Aug. 9, 2007 (JP) ..... 2007-207740

(51) Int. Cl.
*G06F 7/70* (2006.01)
*G06F 19/00* (2011.01)
*G06G 7/00* (2006.01)
(Continued)

(52) U.S. Cl.
CPC ..... *E02F 9/2242* (2013.01); *E02F 9/2235* (2013.01)

(58) Field of Classification Search
CPC ..... E02F 9/2242; E02F 9/2235
USPC ..... 701/50; 37/416
See application file for complete search history.

(56) References Cited

U.S. PATENT DOCUMENTS 5,127,227 A 7/1992 Ikari
5,862,868 A 1/1999 Yamamoto et al.
6,405,844 B1 6/2002 Takamatsu
(Continued)

FOREIGN PATENT DOCUMENTS

EP 0 585 462 A1 3/1994
JP 2579587 Y2 6/1998
(Continued)

OTHER PUBLICATIONS

Extended European Search report mailed Jul. 4, 2011 in corresponding EP application No. 08791403.2.
(Continued)

*Primary Examiner* — Maceeh Anwari
(74) *Attorney, Agent, or Firm* — Posz Law Group, PLC

(57) ABSTRACT

A working vehicle has improved operability and working efficiency during loading. A loading operation detector detects the start of a loading operation based on at least two of the following: whether a boom lever has been operated in its raise direction; whether a boom is in an attitude set in advance; whether the boom angle is less than an upper limit; whether a speed ratio when a brake is OFF is greater than or equal to a predetermined value; whether a predetermined speed stage is set; whether the traveling range has been changed from reverse to forward; and whether the angular velocity of the boom is greater than or equal to a predetermined value. By increasing the discharge amount of a loader pump, and/or by supplying hydraulic fluid to a boom cylinder from a switch pump, a hydraulic fluid amount increase controller supplies more hydraulic fluid to the boom.

15 Claims, 18 Drawing Sheets

(51) Int. Cl.
*G06G 7/76* (2006.01)
*E02F 9/22* (2006.01)

(56) References Cited

U.S. PATENT DOCUMENTS

| | | | | |
|---|---|---|---|---|
| 6,582,340 | B1 | 6/2003 | Arie et al. | |
| 8,321,095 | B2 * | 11/2012 | Kawasaki et al. | 701/50 |
| 2004/0188168 | A1 | 9/2004 | Aumann | |
| 2006/0161324 | A1 | 7/2006 | Ozawa et al. | |
| 2006/0276948 | A1 * | 12/2006 | Toda | 701/50 |
| 2008/0154466 | A1 * | 6/2008 | Shenoy et al. | 701/50 |
| 2008/0300757 | A1 * | 12/2008 | Kanayama et al. | 701/50 |
| 2009/0111655 | A1 | 4/2009 | Hatanaka | |
| 2010/0131158 | A1 * | 5/2010 | Saito | 701/50 |
| 2010/0324788 | A1 * | 12/2010 | Toda | 701/50 |
| 2010/0332061 | A1 * | 12/2010 | Forslow et al. | 701/22 |
| 2011/0276238 | A1 * | 11/2011 | Toda | 701/50 |

FOREIGN PATENT DOCUMENTS

| | | | |
|---|---|---|---|
| JP | 2843002 | B2 | 10/1998 |
| JP | 11-181841 | A | 7/1999 |
| JP | A-2001-146928 | | 5/2001 |
| JP | A-2006-521238 | | 9/2006 |
| WO | WO 2007/043290 | A1 | 4/2007 |
| WO | WO 2007/066602 | | 6/2007 |
| WO | WO 2007/105993 | A1 | 9/2007 |

OTHER PUBLICATIONS

Office Action mailed Jul. 22, 2011 in corresponding CN application No. 200880110573.2 (English translation enclosed).
International Search Report mailed on Oct. 7, 2008 for the corresponding International patent application No. PCT/JP2008/063122.
Office Action mailed Feb. 21, 2012 issued from the Japan Patent Office for corresponding Japanese patent application No. 2009-526385 (copy and English translation enclosed).

* cited by examiner

WORKING VEHICLE AND HYDRAULIC FLUID AMOUNT CONTROL METHOD FOR WORKING VEHICLE

CROSS REFERENCE TO RELATED APPLICATIONS

This application is a U.S. national stage application of PCT/JP2008/063122 filed on Jul. 22, 2008, and claims priority to, and incorporates by reference, Japanese Patent Application No. 2007-207740 filed on Aug. 9, 2007.

TECHNICAL FIELD

The present invention relates to a working vehicle, and to a hydraulic fluid amount control method for a working vehicle.

BACKGROUND ART

With a wheel loader, taken as an example as one type of working vehicle, an output of the engine is used as power for working and also as power for traveling. With the wheel loader, a load such as earth or sand or the like is scooped up by a bucket as a working apparatus, the bucket is lifted up by a boom, and then the load is dumped upon a bed or the like of a truck. It is possible to enhance working efficiency by raising the bucket which the load has been filled rapidly.

Thus, in the prior art, during loading operation, an operator operates a brake pedal and an accelerator pedal at the same time. Due to this, it has been proposed to increase a rotational speed of a hydraulic fluid pump during low speed traveling, so as to increase the amount of hydraulic fluid supplied to the working apparatus (refer to Patent Document #1). It should be understood that a technique is also per se known for controlling the degree of engagement of a clutch according to the difference between rotational speeds of left and right drive wheels.

Patent Document #1: JP-A-2006-521238.
Patent Document #2: JP-A-2001-146928.

DISCLOSURE OF THE INVENTION

Problems to be Solved by the Invention

In the prior art, it has been required to operate the accelerator pedal and the brake pedal at the same time in order to increase the amount of hydraulic fluid supplied to the working apparatus, and thus, from the point of view of operability, there has been room for improvement. Moreover it is basically useless for the power which is distributed to the traveling system to be thus wasted by being converted into heat by the brakes. Systems also exist in which, separately from the normal brake pedal, a special type of brake pedal is provided to the working vehicle which combines a function as a brake and a function for operating the clutch. Even with a working vehicle which is equipped with this special type of brake pedal, loss of power occurs due to braking operation, since this special type brake pedal is operated when operating the clutch in order to distribute the power to the working apparatus side.

The present invention has been conceived in the light of the problems described above, and its object is to provide a working vehicle, and a hydraulic fluid amount control method for a working vehicle, which make it possible to enhance the working efficiency. Another object of the present invention is to provide a working vehicle, and a hydraulic fluid amount control method for a working vehicle, which make it possible to detect automatically the fact that loading operation is being performed, thus enhancing the operability and improving the efficiency of such loading operation, and which make it possible to utilize the power of the engine in an efficient manner in order to raise the boom. Yet further objects of the present invention will become apparent from the following description of embodiments thereof.

Means for Solving the Problems

In order to solve the problems described above, according to the present invention, there is proposed a working vehicle in which an output from an engine is distributed via a splitter to each of a traveling system and a hydraulic system, wherein: the traveling system comprises: a clutch connected to the engine via the splitter, a transmission which transmits drive force outputted from the clutch to drive wheels according to a set speed stage, and a vehicle speed detection means; and the hydraulic system comprises: one or more pumps driven via the splitter, a boom rotatably provided to one end of a vehicle body, a bucket rotatably provided to one end of the boom, a boom cylinder for rotating the boom, a bucket cylinder for rotating the bucket, a first control valve which supplies hydraulic fluid discharged from a first pump included in the pumps to the boom cylinder and to the bucket cylinder, according to the operation amounts of a boom lever and a bucket lever, and a second pump included in the pumps and capable of supplying hydraulic fluid to the boom cylinder via the first control valve; and comprising: an operational state detection means which detects the loading operation state of the working apparatus; and a hydraulic fluid amount increase control means which increases an amount of hydraulic fluid supplied to the boom cylinder, upon the detection of the loading operation state.

The operational state detection means may determine whether or not loading operation is being performed with the boom and the bucket. The expression "loading operation is being performed" may also include the starting of loading operation.

The operational state detection means may perform the detection as to whether or not loading operation is being performed, on the basis of at least two parameters among: the operation amount of the boom lever; an angle of the boom; a speed stage to which the transmission is set; a vehicle speed detected by the vehicle speed detection means; a traveling range to which the transmission is set; and a speed of extension of the boom cylinder.

The operational state detection means may determine that loading operation is being performed by the boom and the bucket, if: the boom lever is being operated so as to raise the boom; the angle of the boom is at least equal to a predetermined angle which is set in advance; the angle of the boom is less than a maximum angle which is set in advance; and also a ratio between an input rotational speed and an output rotational speed of the clutch is greater than or equal to a predetermined value which is set in advance.

The operational state detection means may determine that loading operation is being performed by the boom and the bucket, if at least two of the following conditions is satisfied: (a) the boom lever is being operated so as to raise the boom; (b) the angle of the boom is greater than or equal to a predetermined angle which is set in advance; (c) the angle of the boom is less than a maximum angle which is set in advance; (d) the ratio between the input rotational speed and the output rotational speed of the clutch is greater than or equal to a predetermined value which is set in advance; (e) the speed stage set for the transmission is the same as a predetermined speed stage which is set in advance; (f) the traveling range set for the transmission has been changed over from reverse to forward; (g) the speed of extension of the boom cylinder is positive; and (h) the vehicle speed detected by the vehicle speed detection means is greater than or equal to a predetermined speed which is set in advance.

The hydraulic fluid amount increase control means may increase the flow amount of hydraulic fluid supplied to the boom cylinder by decreasing the clutch pressure commanded for the clutch.

The hydraulic fluid amount increase control means may increase the flow amount of hydraulic fluid supplied to the boom cylinder by increasing the flow amount of hydraulic fluid discharged from the first pump.

The hydraulic fluid amount increase control means may increase the flow amount of hydraulic fluid supplied to the boom cylinder by supplying hydraulic fluid to the boom cylinder from the second pump, in addition to the hydraulic fluid discharged from the first pump.

The hydraulic fluid amount increase control means may increase the flow amount of hydraulic fluid supplied to the boom cylinder by decreasing the clutch pressure commanded for the clutch, and by supplying hydraulic fluid to the boom cylinder from the second pump, in addition to the hydraulic fluid discharged from the first pump.

And the operational state detection means may determine that loading operation is being performed by the boom and the bucket, if: the boom lever is being operated so as to raise the boom; the angle of the boom is at least equal to a predetermined angle which is set in advance; the angle of the boom is less than a maximum angle which is set in advance; and also the ratio between the input rotational speed and the output rotational speed of the clutch is greater than or equal to a predetermined value which is set in advance; with also the hydraulic fluid amount increase control means increasing the flow amount of hydraulic fluid supplied to the boom cylinder by decreasing the clutch pressure commanded for the clutch.

And, according to another aspect of the present invention, for a working vehicle which distributes an output from an engine via a splitter to each of a traveling system and a hydraulic system, and wherein: the traveling system comprises: a clutch connected to the engine via the splitter, and a transmission which transmits drive force outputted from the clutch to drive wheels according to a set speed stage; and the hydraulic system comprises: one or more pumps driven via the splitter, a boom rotatably provided to one end of a vehicle body, a bucket rotatably provided to one end of the boom, a boom cylinder for rotating the boom, a bucket cylinder for rotating the bucket, a first control valve which supplies hydraulic fluid discharged from a first pump included in the pumps to the boom cylinder and to the bucket cylinder, according to the operation amounts of a boom lever and a bucket lever, and a second pump included in the pumps and capable of supplying hydraulic fluid to the boom cylinder via the first control valve; there is provided a hydraulic fluid amount control method in which are executed: processing in which it is determined whether or not the loading operation is being performed by the working apparatus; and processing in which, if the loading operation state has been detected, the amount of hydraulic fluid supplied to the boom cylinder is increased.

Advantages of The Invention

According to the present invention, it is possible to detect the loading operation state automatically, so that it is possible to increase the amount of hydraulic fluid supplied to the boom cylinder. By doing this, it is possible to enhance the efficiency of the loading operation.

And, according to the present invention, it is possible to detect that the loading operation is being performed automatically, on the basis of a plurality of parameters which are set in advance.

Moreover, according to the present invention, it is possible to increase the amount of hydraulic fluid which is supplied to the boom cylinder by decreasing the clutch pressure, or by supplying hydraulic fluid from a first pump and a second pump to the boom cylinder, and thus it is possible to enhance the efficiency of operation.

BEST MODE FOR CARRYING OUT THE INVENTION

In the following, several embodiments of the present invention will be described in detail with reference to drawings. In these embodiments, as will be explained below, the power which is distributed to the working apparatus side is automatically controlled according to the operational state.

Embodiment One

In the following, an embodiment of the present invention will be described by citing an application of the present invention to a wheel loader, which is taken as an example of a working apparatus. However, this embodiment may also be applied to a working apparatus of some other type than a wheel loader.

FIG. 1 is an explanatory figure showing an overall structure of a wheel loader. This wheel loader may broadly be subdivided into a mechanical structure 100 and a control structure 200 (hereinafter termed the "controller"). First the mechanical structure 100 will be explained, and then the controller 200 will be explained.

The mechanical structure 100 comprises, for example, an engine 101, an output splitter (PTO: Power Take Off) 102 which distributes the output of the engine 101 between a traveling system 103 and a hydraulic system 104, the traveling system 103 which is for causing the wheel loader 1 to travel, and the hydraulic system 104 which is principally for operating a working apparatus 5.

Now reference will be made to FIG. 3. FIG. 3 is a side view of a wheel loader. The wheel loader 1 comprises a vehicle body 2, two pairs of left and right tires 3 which are provided at the front and the rear of the vehicle body 2, an engine room 4 which is provided at the rear of the vehicle body 2, a working apparatus 5 which is provided at the front of the vehicle body 2, and a operator compartment 6 which is provided at the center of the vehicle body 2.

The vehicle body 2 comprises a rear vehicle body portion 21, a front vehicle body portion 22, and a link portion 23 which links together the rear vehicle body portion 21 and the front vehicle body portion 22. Between the rear vehicle body portion 21 and the front vehicle body portion 22, there are provided a pair of left and right steering cylinders 130. When the operator operates a steering lever 127 (refer to FIG. 1) in an operator compartment 6, the cylinder rod of one of these steering cylinders 130 extends according to this operation, while the cylinder rod of the other steering cylinder 130 retracts. By doing this, the track direction of the wheel loader 1 can be changed.

The engine room contains the engine 101 and pump 120 and so on. The working apparatus 5 comprises a boom 51 which is provided so as to be rotatable to extend forwards and backwards from the front vehicle body portion 22, a bucket 52 which is rotatably mounted at the end of the boom 51, a boom cylinder 128 for rotating the boom 51 in upwards and downwards direction, and a bucket cylinder 129 for rotating the bucket 52.

Returning to FIG. 1, the traveling system 103 comprises, for example, a modulated clutch 110 (hereinafter termed simply a "clutch"), a torque converter 111, a transmission 112, and an axle 113. In the figures, for the sake of convenience of explanation, the clutch is referred to as "Mod/C", the torque converter is referred to as "T/C", and the transmission is referred to as "T/M". The output of the engine 101 (i.e. the rotational torque) is transmitted to the tires 3 via the clutch 110, the torque converter 111, the transmission 112, and the axle 113.

The hydraulic system 104 comprises, for example, a loader pump 120, a switch pump 121, a steering pump 122, a main valve 123, a load sensing (steering) valve (in the figure, referred to as a CLSS: Closed-center Load Sensing System) 124, a bucket lever 125, a boom lever 126, a steering lever 127, a boom cylinder 128, a bucket cylinder 129, a steering cylinder 130, an auxiliary machinery pump 131, and auxiliary machinery 132.

Here, the loader pump 120 corresponds to the "first pump" in the Claims, the switch pump 121 corresponds to the "second pump", and the main valve 123 corresponds to the "first control valve". It should be understood that the load sensing valve 124 may also sometimes be referred to as the "second control valve".

The loader pump 120 is a pump for supplying hydraulic fluid to the boom cylinder 128 and the bucket cylinder 129. The steering pump 122 is a pump for supplying hydraulic fluid to the steering cylinders 130. The switch pump 121 is a pump for supplying hydraulic fluid either to the steering cylinders 130 or the boom cylinder 128 and the bucket cylinder 129. These pumps 120, 121, and 122 may each, for example, be built as a swash plate type hydraulic pump, with the angle of each of these swash plates being controlled by a control signal from the controller 200.

According to the load, the load sensing valve 124 mechanically controls a destination of supply and the amount of supply of hydraulic fluid discharged from the switch pump 121. The load sensing valve 124 may also be termed a steering valve. During normal traveling, the hydraulic fluid discharged from the switch pump 121 is supplied to the steering cylinders 130 via the load sensing valve 124. In other words, during traveling, the switch pump 121 assists the steering pump 122, and acts for operating the steering cylinders 130. It should be understood that while, in this embodiment, a CLSS valve is used as one example of the load sensing valve (or steering valve) 124, the present invention may also be applied to a structure which utilizes a valve of a type different from a CLSS valve.

On the other hand, during operation, it is arranged for the hydraulic fluid discharged from the switch pump 121 to be supplied to the boom cylinder 128 via the load sensing valve 124 and the main valve 123. In other words, during loading operation, the switch pump 121 assists the loader pump 120, and acts for operating the boom cylinder 128.

The bucket lever 125 is a device for operating the bucket 52. And the boom lever 126 is a device for operating the boom 51. Moreover, the steering lever 127 is a device for operating the steering cylinders 130. Each of these levers 125, 126, and 127 may, for example, comprise an operation unit which is operated by the operator, and a pilot pressure control valve which controls a pilot pressure according to the amount of operation of the operation unit. Furthermore, the main valve 123 supplies hydraulic fluid discharged from the loader pump 120 (or from both the loader pump 120 and the switch pump 121) to the boom cylinder 128 or to the bucket cylinder 129, according to pilot pressure inputted from the bucket lever 125 or from the boom lever 126.

The auxiliary machinery 132 may, for example, include devices such as a cooling fan driven by a hydraulic motor and so on. And the auxiliary machinery pump 131 is a pump for supplying hydraulic fluid to the auxiliary machinery 132.

Sensors 140 of various types are provided at certain positions within the mechanical structure 100. These sensors 140 of various types are a generic term for sensors 141 through 149 which will be described hereinafter with reference to FIG. 2. Conditions of various types detected by these sensors 140 of various types are inputted to the controller 200 as electrical signals.

The controller 200 is built as an electronic circuit which, for example, comprises a calculation unit 210, a memory 220, and an input and output interface unit 230. The calculation unit 210 comprises a loading operation detection means 211 and a working hydraulic fluid amount increase control means 212 (sometimes hereinafter abbreviated as the "hydraulic fluid amount increase control means 212").

The loading operation detection means 211 is a function for detecting whether or not loading operation is currently being performed, as will be described hereinafter. And the hydraulic fluid amount increase control means 212 is a function for increasing the amount of hydraulic fluid supplied to the boom cylinder 128 during loading operation.

The memory 220 is a storage medium for storing, for example, a program 221, parameters 222, and tables 223. By reading in the program 221 from the memory 220, the calculation unit 210 detects whether or not loading operation is being performed, and increases the amount of hydraulic fluid supplied to the boom cylinder 128. The parameters 222 are threshold values and setting values which are used by the loading operation detection means 211 and the hydraulic fluid amount increase control means 212. And the tables 223 are tables which are used by the loading operation detection means 211 and the hydraulic fluid amount increase control means 212.

The input and output interface unit 230 is a circuit for sending and receiving electrical signals between the sensors 140 of various types, the clutch 110, the transmission 112, and the pumps 120 through 122 and 131. The calculation unit 210 receives signals from the various sensors 140 via the input and output interface unit 230. Moreover, the calculation unit 20 outputs control signals to the clutch 110 and the pumps 120 through 122 and 131 via the input and output interface unit 230. It should be understood that the structure of the controller 200 described above is shown as simplified down to a level required for understanding and implementation of the present invention; thus, the present invention should not be considered as being limited to the structure described above.

FIG. 2 is an explanatory figure, schematically showing the functions of the controller 200. Sensors 141 through 149 which constitute sensors 140 of various types are connected to the controller 200. A traveling range sensor 141 detects to which of the traveling ranges forward (F), neutral (N), and reverse (R) the transmission 112 is currently set. The speed stage to which the transmission 112 is currently set may also be detected by the traveling range sensor 141. The traveling range sensor 141 need not be constituted as an actual sensor. It is possible for the traveling range and the speed stage to be derived by utilizing signals outputted to the transmission 112 from a transmission control circuit within the controller 200.

A boom lever operation amount sensor 142 detects the operating direction and the operation amount of the boom lever 126. A boom angle sensor 143 detects the angle of the boom 51. An engine rotational speed sensor 144 detects the rotational speed of the engine 101. A clutch output rotational speed sensor 145 detects the output rotational speed of the clutch 110. A transmission output rotational speed sensor 146 detects the output rotational speed of the transmission 112. A brake pedal operation amount sensor 147 detects the operation amount of a brake pedal within the operator compartment 6. An accelerator pedal operation amount sensor 148 detects the operation amount of an accelerator pedal within the operator compartment 6. And a vehicle speed meter 149 detects the speed of the body of the working vehicle 1, and is one example of the "vehicle speed detection means" of the Claims.

By appropriately utilizing the signals from the various sensors 141 through 149, the loading operation detection means 211 within the controller 200 makes a decision as to whether or not loading operation is being performed. And, if it is detected that loading operation is being performed, then the hydraulic fluid amount increase control means 212 increases the amount of hydraulic fluid supplied to the boom cylinder 128 by increasing an angle of the swash plate of the loader pump 120, and/or by decreasing the clutch pressure of the clutch 110.

The hydraulic fluid amount increase control means 212 comprises, for example, a swash plate command signal control means 212A and a clutch command pressure control means 212B. The first control means 212A outputs a control signal for controlling the angle of the swash plate. And the second control means 212B outputs a control signal for controlling the clutch pressure of the clutch 110.

During loading operation, the first control means 212A outputs a control signal, so as to cause the flow amount of hydraulic fluid discharged from the loader pump 120 to be increased. If some other control signal is also outputted from some other control means for controlling the angle of the swash plate, then the one of the control signal from the first control means 212A and the other control signal, whose value is the larger, is inputted to the loader pump 120.

On the other hand, during loading operation, the second control means 212B outputs a control signal so as to decrease the clutch pressure of the clutch 110, and so as thus to distribute more of the output of the engine 101 to the side of the working apparatus 5. If some other control signal is also outputted from some other control means for controlling the clutch pressure, then the one of the clutch pressure control signal from the second control means 212B and the other clutch pressure control signal, whose value is the smaller, is inputted to the clutch 110. For example, if a special type of brake is provided to the working vehicle (the special type of brake is also sometimes termed a "left brake"), then the clutch command pressure due to the special type of brake corresponds to one such other clutch pressure control signal.

FIG. 4 is an explanatory figure showing the situation during loading operation. By the operator lifting the boom 51 up to a bed of a dump truck 10 and rotate the bucket 52 in the dumping direction and a load in the bucket 52 is dumped on the bed of the dump truck 10.

FIG. 5 is an explanatory figure schematically showing the flow of operation by the wheel loader 1. The wheel loader 1 repeatedly performs the same cycle of operations, in which it digs into a heap 11 of earth or sand or the like which is an object of excavation and loads it into a means for transportation such as the dump truck 10.

Thus, in a first working process P1, the operator drives the wheel loader 1 towards the object of excavation 11, in the state in which the bucket 52 is lowered down to be close to the ground surface. Then, after having thrust the bucket 52 into the object of excavation 11, the operator rotates the bucket 52 in the tilt direction, so that a load is held in the bucket 52.

Next, in a second working process P2, the operator raises the bucket 52 by a certain amount from the ground surface, with the load held in it, makes the wheel loader 1 in traveling position and drives the wheel loader 11 to move in reverse.

Then, in a third working process P3, while keeping the boom 51 raised, the operator approaches the dump truck, and then, as shown in FIG. 4, dumps the load in the bucket 52 on the bed of the dump truck 10.

Finally, in a fourth working process P4, the operator backs the wheel loader 1 away from the dump truck while lowering the boom 51. Then the cycle returns back to the first working process P1 again.

FIG. 6 is an explanatory figure, schematically showing the angle of the boom 51 in the initial state when loading operation has been started. The state will be taken as a reference in which a line A1-A1, connecting a rotation center of the boom 51 and a rotation center of the bucket 52, is parallel to the ground surface (i.e. to a horizontal plane). In this embodiment, the state in which the boom 51 has been rotated in the downwards direction from the reference line A1-A1 by an angle θb is detected as being the initial state in which loading is started. The value of θb may, for example, be −10°. However, this value is only an example, and should not be considered as being limitative of the present invention.

And it may be decided that loading operation has been started, when a line A2-A2 which connects the rotation center of the boom 51 and the rotation center of the bucket 52 is positioned more upwards than its position in which it has been rotated by θb in the anticlockwise direction from the reference line A1-A1. By doing this, in this embodiment, raise of the boom 51 by at least the angle of the boom 51 during traveling is detected.

It should be understood that the definition shown in FIG. 6 is only an example, and should not be considered as being limitative of the present invention. For example, as shown in FIG. 17 which will be described hereinafter, it would also be acceptable to adopt the "Carry Position" as defined by the SAE (Society of Automotive Engineers) standard.

FIG. 7 shows a table T1 which is used for controlling the clutch command pressure. The tables T1 and T2 shown in FIGS. 7 and 8 are examples of the tables 223 shown in FIG. 1. The operation amount of the boom lever 126 (in %) is shown along the horizontal axis in FIG. 7, while the clutch command pressure (in kg/cm$^2$) is shown along the vertical axis in FIG. 7. The boom lever operation amount is the operation amount when the boom 51 is raised. The thick solid line in the figure shows the case when the operation amount of the accelerator pedal is 0%, while the single dotted broken line in the figure shows a case when the operation amount of the accelerator pedal is 100%. In a range of operation amount of the accelerator pedal above 0% and below 100%, values which are obtained by interpolation from the characteristic for 0% shown by the solid line and the characteristic for 100% shown by the broken line are used.

In a range of boom lever operation amount from 0% to 50%, the clutch command pressure is kept high, so that the output of the engine 101 is distributed to the traveling system more. When the boom lever operation amount is greater than 50%, the clutch command pressure is decreased according to the boom lever operation amount. The table T1 sets that the greater the operation amount of the accelerator pedal becomes, the higher decrease rate of the clutch pressure become. In other words, in this embodiment, the greater the operation amount of the accelerator pedal becomes, the more the clutch 110 is slipped, so that the output of the engine 101 is distributed to the side of the working apparatus 5 more. During clutch operation with the left brake, the clutch command pressure value due to the left brake is compared with a command value obtained from the table T1, and the lower of these command values is adopted.

FIG. 8 shows a table T2 which is used for controlling the angle of the swash plate of the loader pump 120. The boom lever operation amount (in %) is shown along the horizontal axis in FIG. 8, while the target flow amount (in %) is shown along the vertical axis in FIG. 8. The boom lever operation amount is the operation amount when the boom 51 is raised. And the target flow amount is the proportion with respect to the maximum flow amount. The table T2 sets that the greater the boom lever operation amount becomes, the greater the flow amount demanded from the loader pump 120 become.

FIG. 9 is a flow chart showing process for detecting whether or not loading operation is being performed. The flow charts explained below are summaries of the process to an extent required to understand and implement the present invention. If all of the conditions described below are satisfied, then the controller 200 decides that loading operation (the process P3 in FIG. 5) has started.

As a first condition, the controller 200 makes a decision as to whether or not the boom lever 126 has been operated in its raise direction (a step S10). Operation of the boom 51 in the raise direction means operation of the boom 51 in order to raise it. This decision as to whether or not the boom lever 126 has been operated in the raise direction, is taken because, during loading operation, it is necessary to raise the boom 51.

As a second condition, the controller 200 makes a decision as to whether or not the boom angle θb is greater than a predetermined angle θ1 which is set in advance (a step S11). As shown in FIG. 6, θ1 may be set to, for example, −10°. This decision as to whether or not the angle θb of the boom 51 has become greater than the angle during traveling is taken because, during loading operation, the wheel loader 1 approaches the dump truck 10 while the boom 51 is raised.

As a third condition, the controller 200 makes a decision as to whether or not the boom angle θb is less than an upper limit angle θmax which is set in advance (a step S12). This check as to whether or not the boom angle θb is less than the upper limit angle θmax is performed because, during loading operation, if the boom 51 is already raised to its upper limit, more hydraulic fluid than the amount being supplied at the present is not required.

As a fourth condition, the controller 200 makes a decision as to whether or not it is the case either that a speed ratio is greater than R1 while the brake is OFF, or that the brake is ON (a step S13). The brake being OFF means that the brake pedal is not being operated. The speed ratio is the value obtained by dividing the output rotational speed of the torque converter 111 by the input rotational speed of the torque converter 111. It would also be acceptable for it to be the value obtained by dividing the output rotational speed of the clutch 110 by the input rotational speed of the clutch 110. And the brake ON state is the state in which the brake is being applied by operation of the brake pedal.

If, while the brake is OFF, the speed ratio is less than R1 (where R1 may be set, for example, to 0.3) (i.e., when the speed ratio<R1), this means that the wheel loader 1 is being accelerated, or that the digging operation shown in FIG. 5 (the process P1) is being performed. In this case, it will be acceptable for the amount of hydraulic fluid distributed to the working apparatus to be relatively low.

If all of the four conditions described above are satisfied, then the controller 200 decides that loading operation is now taking place (a step S14).

FIG. 10 is a flow chart showing processing for increasing the amount of hydraulic fluid supplied. When the controller 200 determines that loading operation is being performed (YES in the step S20), then it performs a plurality of hydraulic fluid amount increase procedures, as described below.

In a first stage hydraulic fluid amount increase procedure, using the table T1 shown in FIG. 7, the controller 200 determines a command pressure for the clutch 110, according to the boom lever operation amount and the accelerator pedal operation amount (a step S21). And the controller 200 outputs this clutch command pressure to the clutch 110 (the step S21). Due to decrease of the clutch command pressure, the amount of engine power distributed to the hydraulic system is increased. Because of this, it is possible to increase the amount of hydraulic fluid supplied to the working apparatus 5.

In a second stage hydraulic fluid amount increase procedure, using the table T2 shown in FIG. 8, the controller 200 determines a target flow amount corresponding to the boom lever operation amount, sets a swash plate angle for implementing the determined target flow amount, and outputs an appropriate control signal to the loader pump 120 (a step S22).

In a third stage hydraulic fluid amount increase procedure, the controller 200 sets the swash plate angle so as to increase the discharge amount from the switch pump 121, and outputs an appropriate control signal to the switch pump 121 (a step S23). For example, the controller 200 may set the swash plate angle of the switch pump 121 on the basis of the calculation equation: swash plate angle of switch pump 121 (%)=swash plate angle determined by load sensing valve 124 (%)+ amount to be added corresponding to the boom lever operation amount (%).

The swash plate angle due to the load sensing valve is a swash plate angle corresponding to the flow amount which has been determined as necessary for operating the steering cylinders 130. And the amount to be added corresponding to the boom lever operation amount is a swash plate angle corresponding to the flow amount which has been determined as necessary for supporting the loader pump 120. If the sum on the right side of the calculation equation described above is greater than 100%, then the swash plate angle of the switch pump 121 is limited to 100%.

And, in a fourth stage hydraulic fluid amount increase procedure, the controller 200 sets the swash plate angle of the auxiliary machinery pump 131 so that the flow amount of hydraulic fluid discharged from the auxiliary machinery pump 131 decreases, and outputs an appropriate control signal to the auxiliary machinery pump 131 (a step S24). If the auxiliary machinery pump 131 is connected to the output splitter 102 via a clutch pump, then the controller 200 may release the engagement of this pump clutch, instead of controlling the swash plate angle. Due to this, the output which was being distributed to the auxiliary machinery pump 131 is now distributed to the loader pump 120.

By implementing the first through the fourth hydraulic fluid amount increase procedures described above in this manner during loading operation, it is possible to supply a larger amount of hydraulic fluid to the boom cylinder 128, so that it is possible to enhance the speed of raise of the boom 51.

Although, in this embodiment, a case has been explained in which all of the first through the fourth hydraulic fluid amount increase procedures described above are performed, the present invention is not to be considered as being limited thereto. For example, it would also be acceptable for the controller 200 to be adapted to perform only one of the first hydraulic fluid amount increase procedure (the step S21) or the second hydraulic fluid amount increase procedure (the step S22). Moreover, it would also be acceptable for the controller 200 to be adapted to perform only the first, second, and third hydraulic fluid amount increase procedures (the steps S21, S22, and S23), or to perform only the first hydraulic fluid amount increase procedure and the second hydraulic fluid amount increase procedure (the steps S21 and S22), or to perform only the first hydraulic fluid amount increase procedure and the third hydraulic fluid amount increase procedure (the steps S21 and S23), or to perform only the second hydraulic fluid amount increase procedure and the third hydraulic fluid amount increase procedure (the steps S22 and S23).

In this embodiment, due to the structure described above, the following advantages are obtained. In this embodiment, it is possible to detect the loading operation state automatically on the basis of changes in the predetermined parameters such as the boom lever operation amount and the boom angle and so on. Accordingly, it is possible to perform control which responds to the fact of loading operation, so that it is possible to enhance the performance of the wheel loader 1.

In this embodiment, during loading operation, the flow amount of hydraulic fluid supplied to the boom cylinder 128 is increased. Accordingly it is possible to enhance the speed of raise of the boom 51, and thus to shorten the time required for loading operation, so that it is possible to improve the working efficiency. Moreover, since the flow amount of hydraulic fluid to the boom cylinder 128 is automatically increased when loading operation starts, accordingly it becomes unnecessary for the operator to perform any superfluous operation such as operating the brake pedal or the like, so that the operability during loading operation is enhanced.

In this embodiment it is decided that loading operation has been started, if all of the conditions for positively detecting that loading operation is taking place (the steps S10 and S11) and also all of the conditions for preventing erroneous detection (the steps S12 and S13) are satisfied. Accordingly, it is possible to determine that loading operation has started with superior reliability.

And, in this embodiment, when it is determined that loading operation is taking place, the first through the fourth hydraulic fluid amount increase procedures are executed (the steps S21 through S24). Accordingly, it is possible to supply more hydraulic fluid to the boom cylinder 128, and thus to raise the boom 51 more rapidly.

Embodiment Two

Now, certain variant embodiments of the processing for detecting loading operation will be explained. The each embodiment described below is variant of the first embodiment described above. In a second embodiment shown in FIG. 11, the controller 200 decides both whether or not the boom lever 126 has been operated in its raise direction (a step S10), and whether or not the boom angle θb is greater than a predetermined value θ1 (a step S11), and determines that loading operation is taking place if both of these conditions hold (a step S14).

With this embodiment having this structure and operation, similar advantages are obtained as in the case of the first embodiment. In this embodiment, it is possible to simplify the control program as compared with the first embodiment, because the processing for detecting loading operation is shortened as compared with the case for the first embodiment.

Embodiment Three

In a third embodiment shown in FIG. 12, the controller 200 decides upon both the first condition (a step S10) and the fourth condition (a step S13) described for the first embodiment, and determines that loading operation is taking place if both of these conditions hold (a step S14). With this third embodiment having this structure and operation, similar advantages are obtained as in the case of the second embodiment.

Embodiment Four

In a fourth embodiment shown in FIG. 13, the controller 200 decides both whether or not the boom lever 126 has been operated in its raise direction (a step S10), and whether or not the speed stage is set to the second speed stage forward (a step S15), and determines that loading operation is taking place if both of these conditions hold (a step S14). During loading operation it is often the case that the transmission 112 is set to the second forward speed stage, since the wheel loader 1 is brought close to the dump truck 10 with a load being held in the bucket 52.

However, the present invention is not to be considered as being limited to the case of the second forward speed stage. In other words, in the step S15, a decision is made as to whether or not a predetermined speed stage (or one of predetermined speed stages) determined in advance is set. Thus, in the above description, the second forward speed stage was cited as one example of such a predetermined speed stage. With this fourth embodiment having this structure and operation, similar advantages are obtained as in the case of the second embodiment.

Embodiment Five

In a fifth embodiment shown in FIG. 14, the controller 200 decides both whether or not the boom lever 126 has been operated in its raise direction (a step S10), and whether or not the traveling range has been changed over from reverse to forward (a step S16), and determines that loading operation is taking place if both of these conditions hold (a step S14).

As shown in FIG. 5, it is possible to utilize change of the traveling range as one item of information for detecting the start of loading operation, since the traveling range is changed over from reverse to forward when transitioning from the working process P2 to the working process P3. With this fifth embodiment having this structure and operation, similar advantages are obtained as in the case of the second embodiment.

Embodiment Six

In a sixth embodiment shown in FIG. 15, the controller 200 decides both whether or not the boom lever 126 has been operated in its raise direction (a step S10), and whether or not the angular velocity of the boom 51 is greater than zero (a step S17), and determines that loading operation is taking place if both of these conditions hold (a step S14).

During loading operation, the boom 51 is raised at the same time that the wheel loader 1 is being moved towards the dump truck 10. The boom 51 is rotated, so as to be raised, by the cylinder rod of the boom cylinder 128 extending. And, according to this extension of the cylinder rod of the boom cylinder 128, the boom cylinder 128 is rotated in a clockwise direction around its base end as a fulcrum. Accordingly, by obtaining the angular velocity of the boom 51 on the basis of the detection signal from the boom angle sensor 143, it is possible to determine whether or not the boom 51 is being raised.

With this sixth embodiment having this structure and operation, similar advantages are obtained as in the case of the second embodiment. It should be understood that the angular velocity of the boom 51 may also be detected as being the angular velocity of the boom cylinder 128. Furthermore it would also be acceptable to make a decision as to whether or not the speed of extension of the cylinder rod of the boom cylinder 128 (instead of its angular velocity) is greater than or equal to zero. The speed of extension of the cylinder rod may be calculated from the angular velocity of the boom cylinder 128; or, alternatively, it would also be acceptable to calculate the speed of extension of the cylinder rod using a linear sensor which detects the amount of displacement of the cylinder rod directly.

Embodiment Seven

In a seventh embodiment shown in FIG. 16, the controller 200 decides both whether or not the traveling range has been changed over from reverse to forward (a step S16), and whether or not the angular velocity of the boom 51 is greater than zero (a step S17), and determines that loading operation is taking place if both of these conditions hold (a step S14). With this seventh embodiment having this structure and operation, similar advantages are obtained as in the case of the second embodiment.

Embodiment Eight

In a eighth embodiment shown in FIG. 17, instead of the step S11 in FIG. 9, the controller 200 makes a decision as to whether or not the boom angle θb is at the "Carry Position" as defined by the SAE standard (a step S11A). Since the SAE standard is an ISO standard, the step S11A may also be described as " . . . makes a decision as to whether or not the boom angle θb is at the "Carry Position" as defined by the ISO standard". With this eighth embodiment having this structure and operation, similar advantages are obtained as in the case of the second embodiment.

Embodiment Nine

Finally, in a ninth embodiment shown in FIG. 18, instead of the step S15 in FIG. 13, the controller 200 makes a decision as to whether or not the vehicle speed V is greater than a predetermined constant speed level V1 which is set in advance (a step S18). If the boom angle θb is greater than θ1 (YES in the step S11), and moreover the vehicle speed V is greater than V1, then it can be decided that loading operation is being performed.

It should be understood that the present invention is not limited to the embodiments described above. For a person of ordinary skill in the art, it is possible to make various additions and alterations and so on, within the range of the present invention. For example, in the embodiments described above, the following possibilities have been cited as information for determining that loading operation is being performed: whether the boom lever has been operated in its raise direction; whether the boom angle is greater than or equal to a predetermined value; whether the boom angle is in the "Carry Position" as defined by the SAE standard; whether the boom angle is less than an upper limit angle; whether the speed ratio while the brake is OFF is greater than or equal to a predetermined value; whether a predetermined speed stage is set; whether the traveling range has changed over from reverse to forward; and whether the angular velocity of the boom (i.e. the boom cylinder angular velocity) is greater than or equal to a predetermined value. And, in the various embodiments, a plurality of examples have been explained in which the information (i.e. the parameters) thus cited by way of example has been combined in various appropriate combinations. However, the present invention is not limited to those combinations of the above conditions which have been explicitly described above, which are only particular examples of specific implementations; other combinations are also to be considered as being included within the scope of the present invention.

Explanation Of The Reference Symbols

Figure 1:
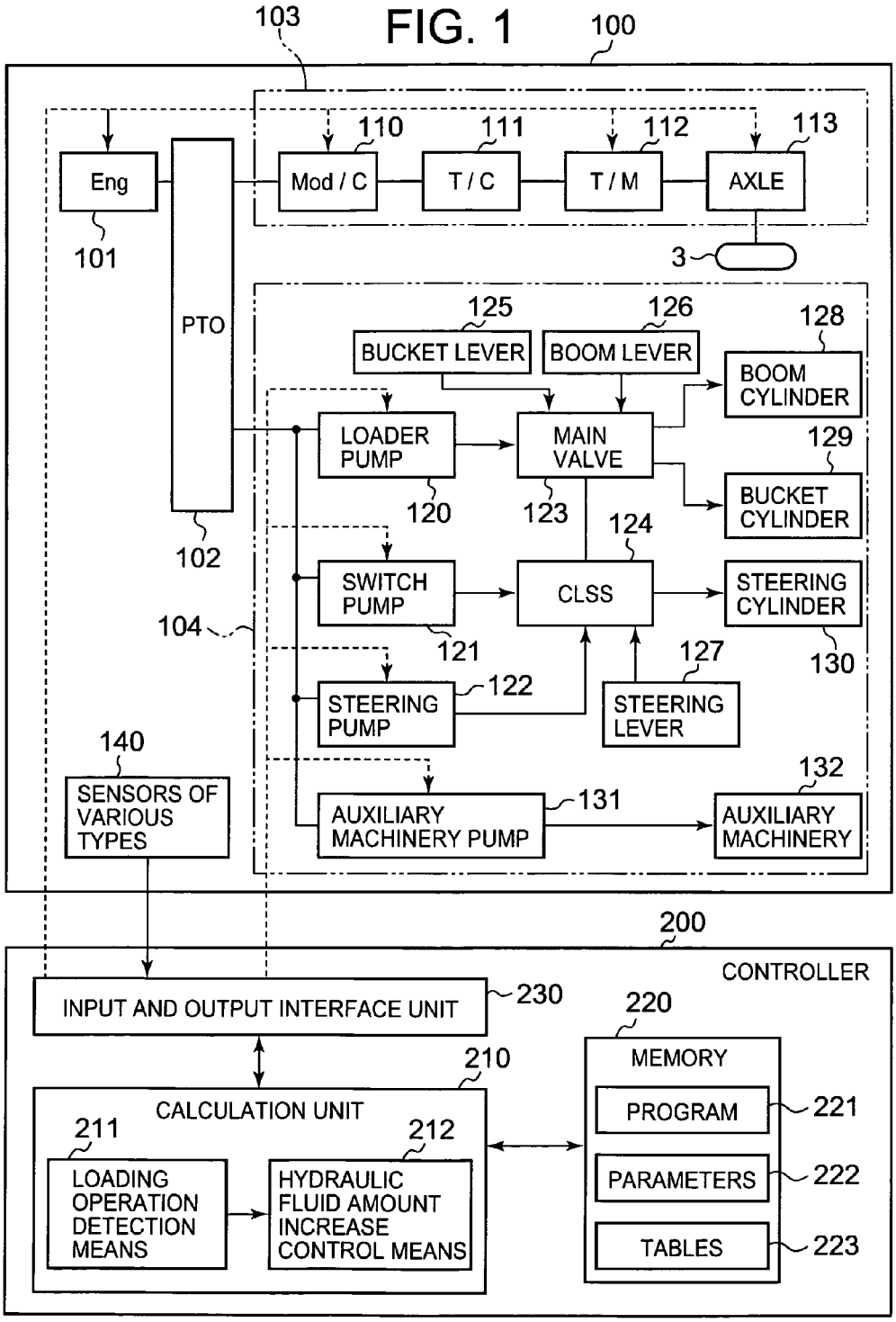
FIG. 1 is an explanatory figure showing the overall structure of a working vehicle according to a first embodiment.
Figure 2:
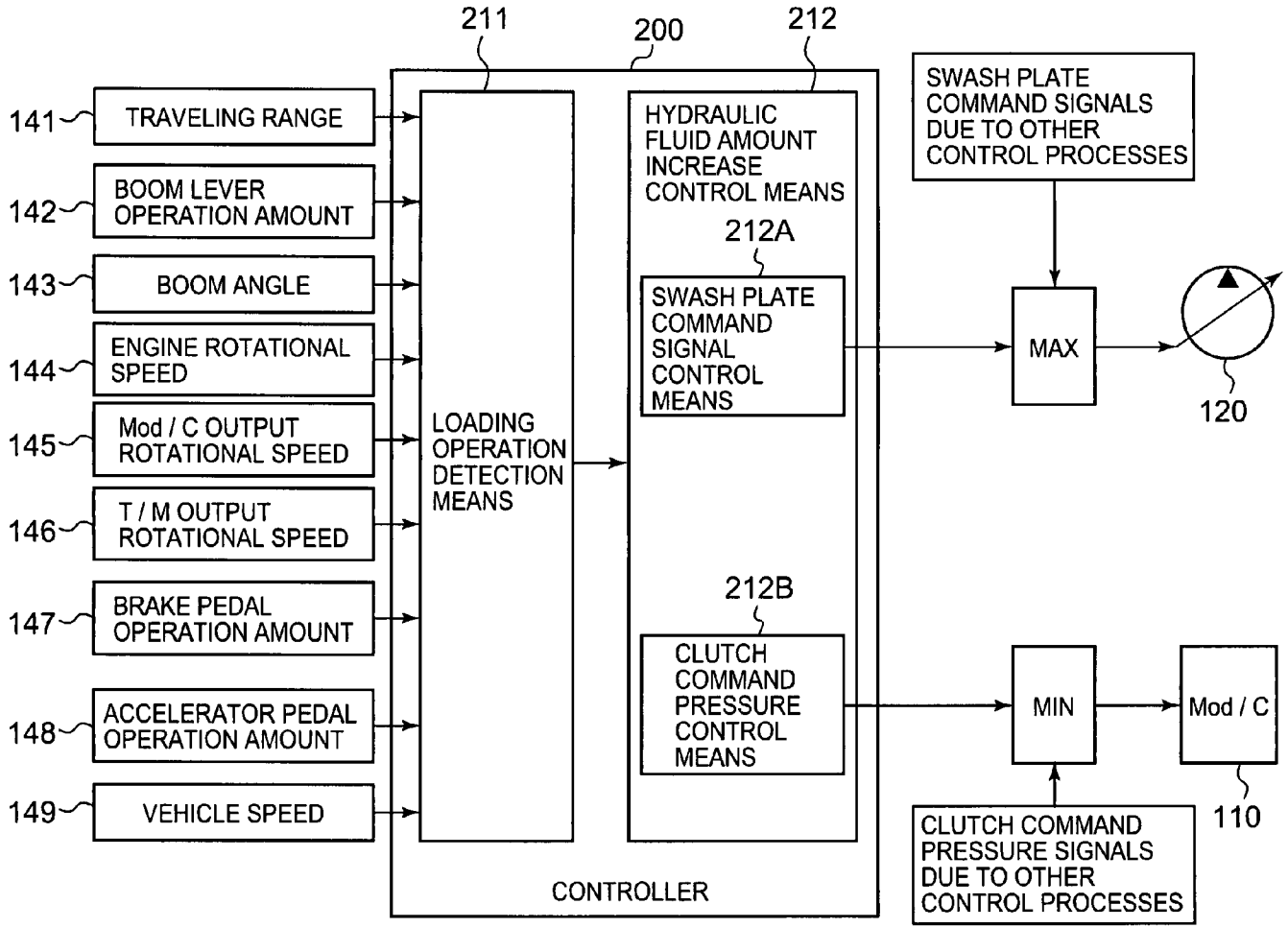
FIG. 2 is an explanatory figure, schematically showing the functions of a controller.
Figure 3:
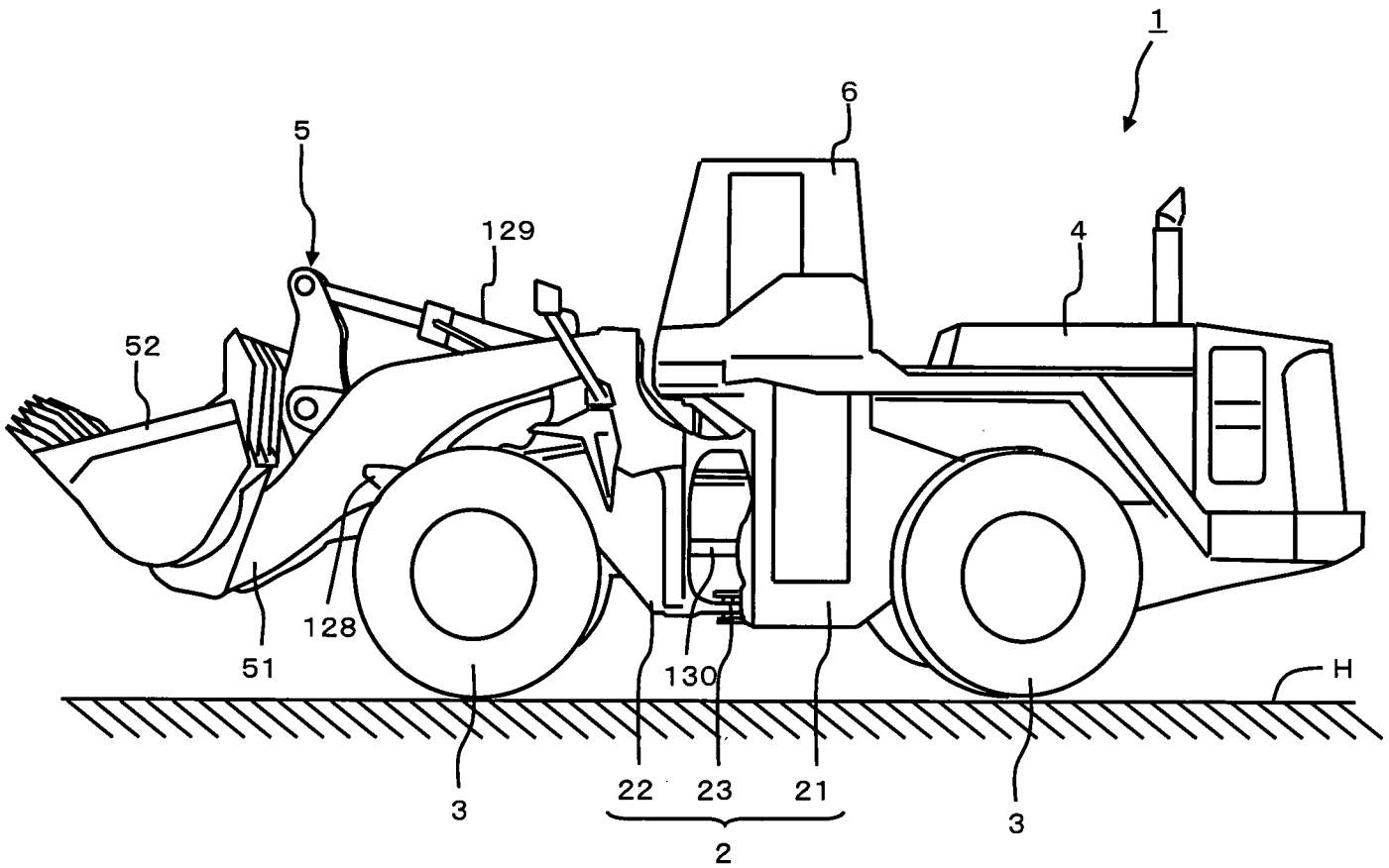
FIG. 3 is a side view of a wheel loader.
Figure 4:
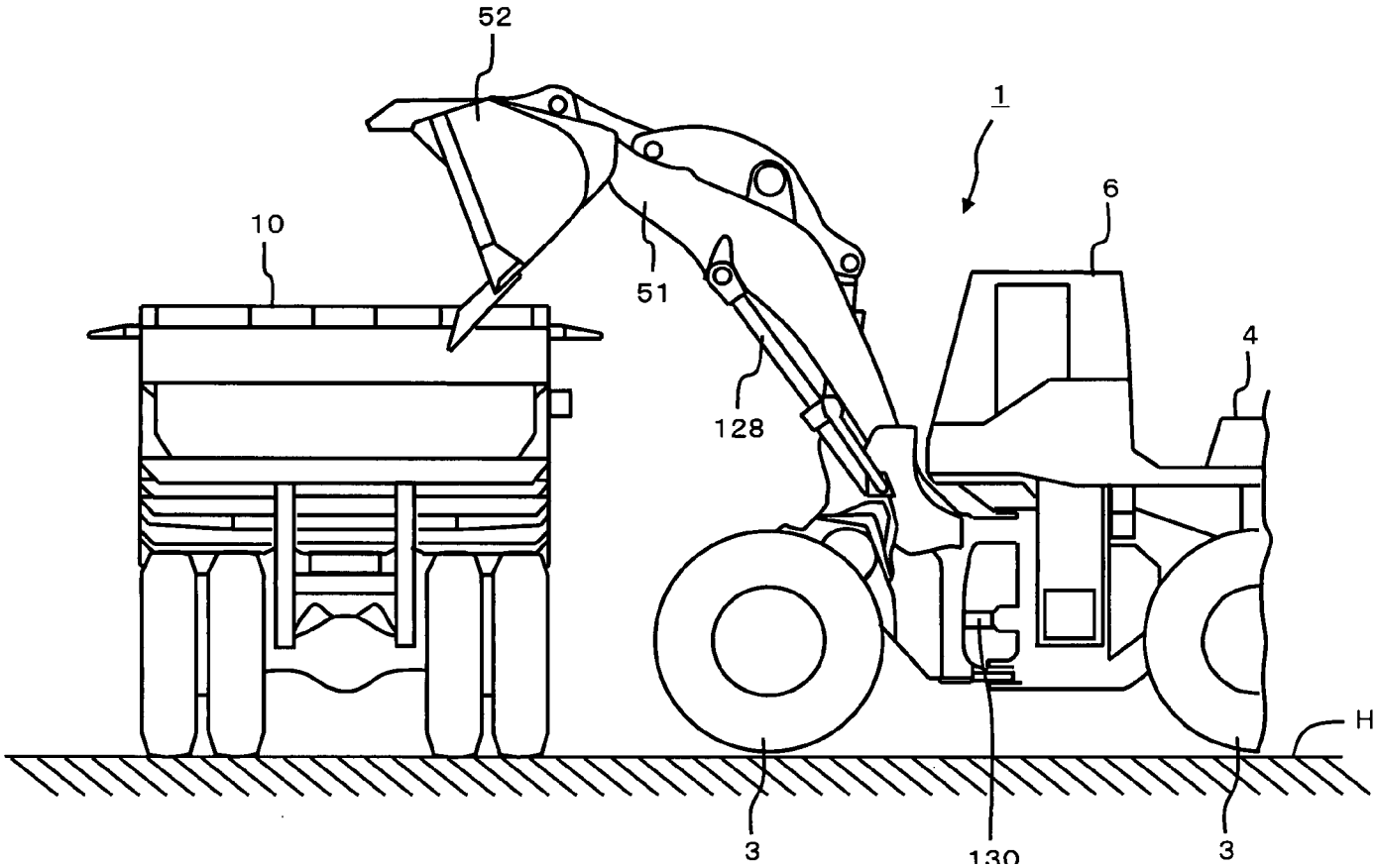
FIG. 4 is an explanatory figure showing a situation during loading operation.
Figure 5:
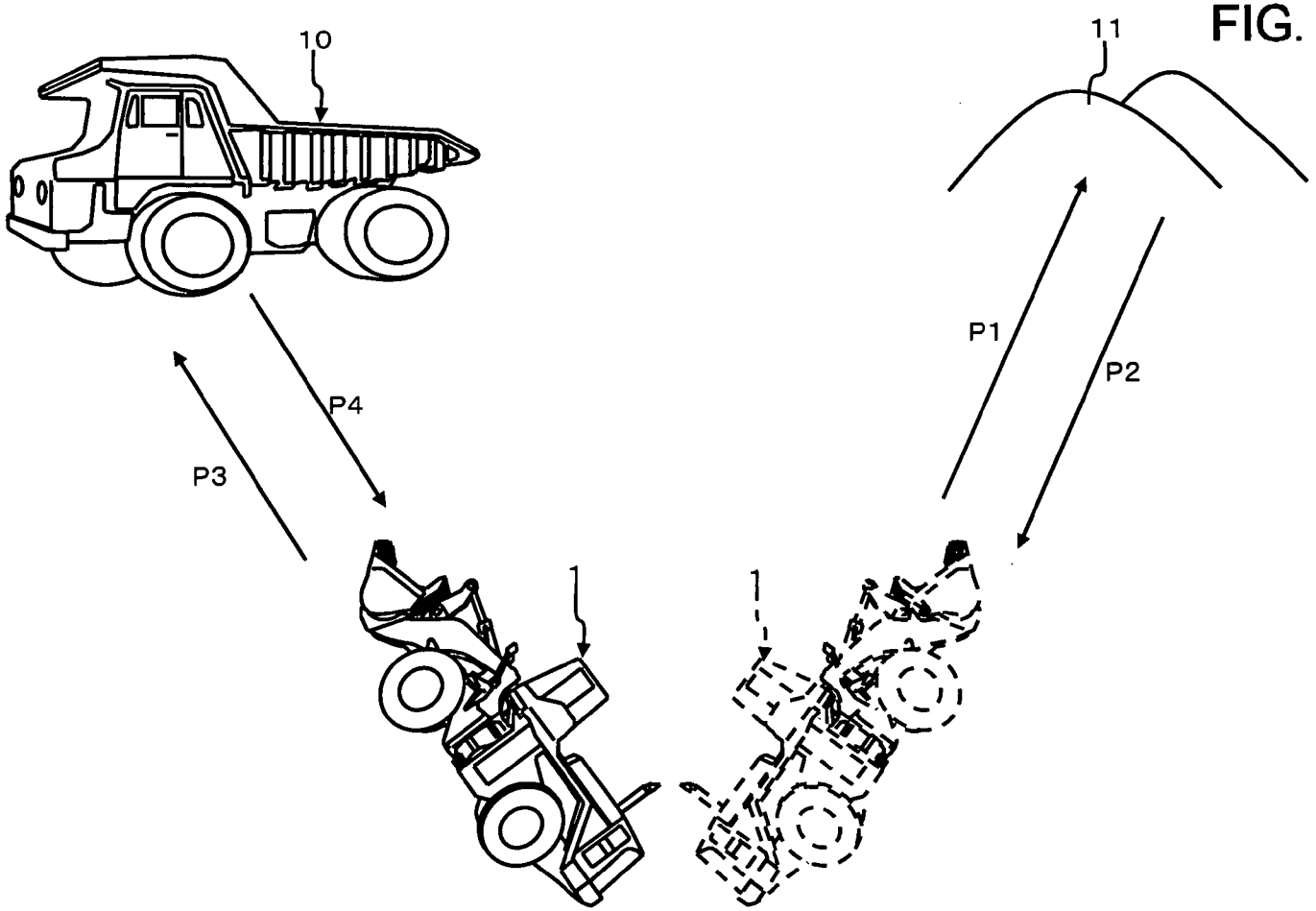
FIG. 5 is an explanatory figure showing the process of working by this wheel loader.
Figure 6:
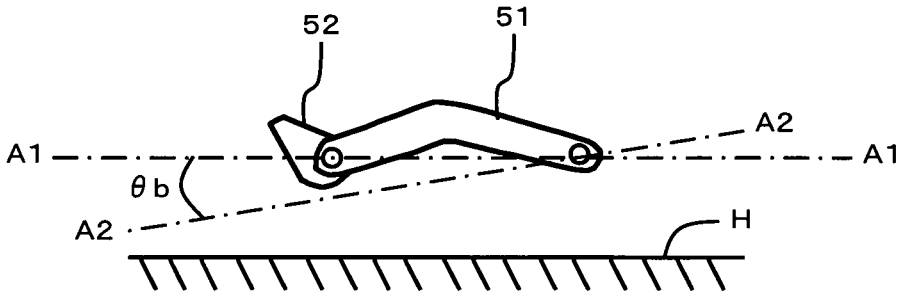
FIG. 6 is an explanatory figure for explanation of definition of the attitude of a boom during loading operation.
Figure 7:
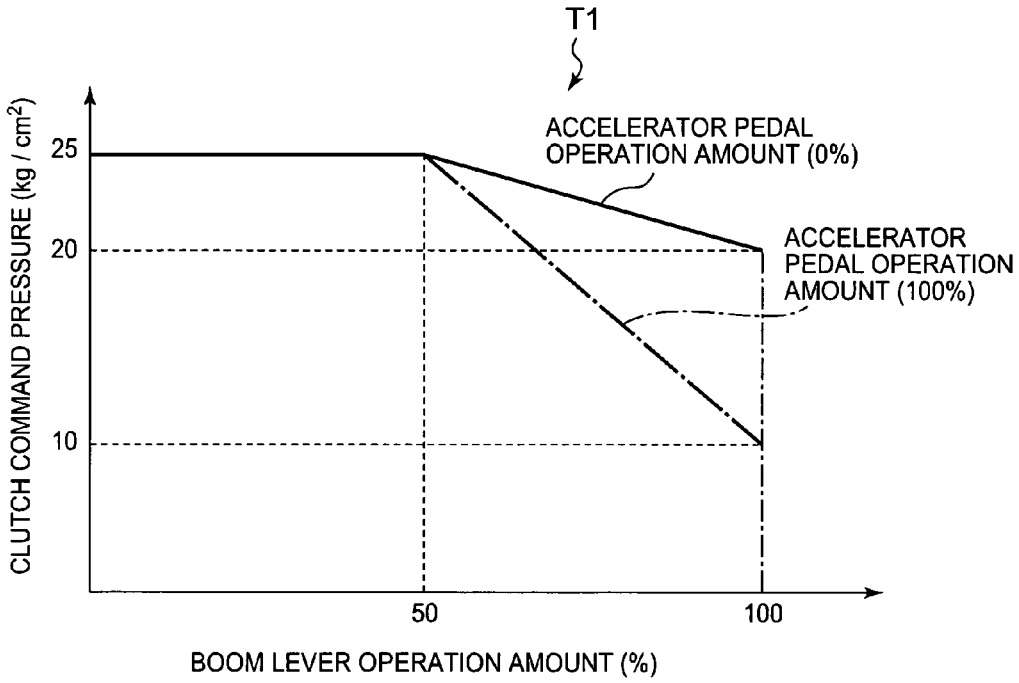
FIG. 7 is a table for setting a clutch command pressure.
Figure 8:
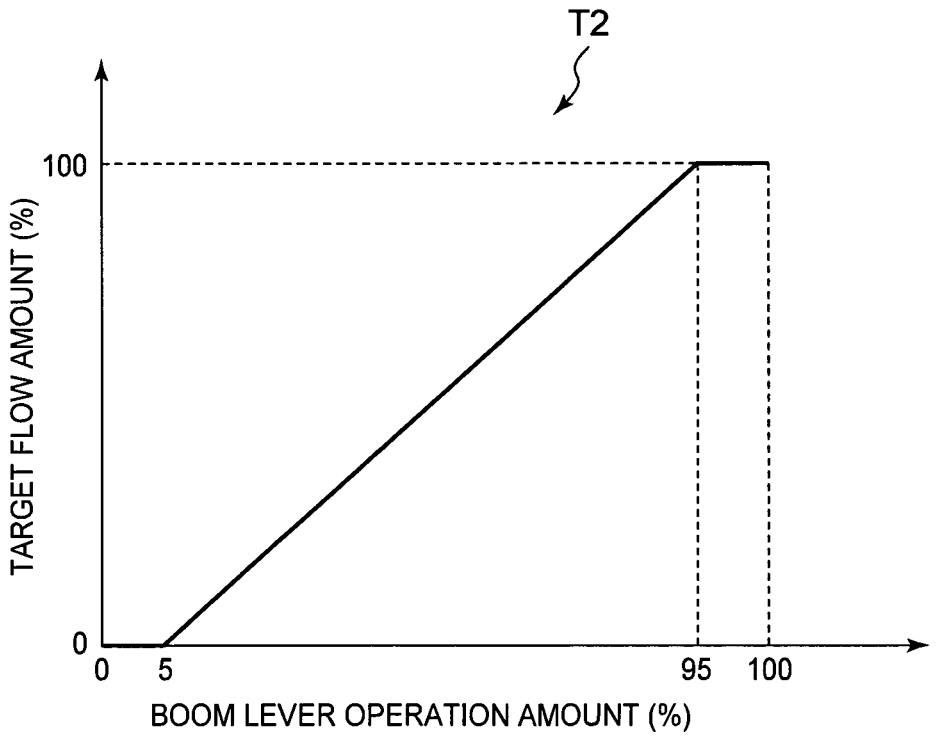
FIG. 8 is a table for setting the discharge amount of a pump.
Figure 9:
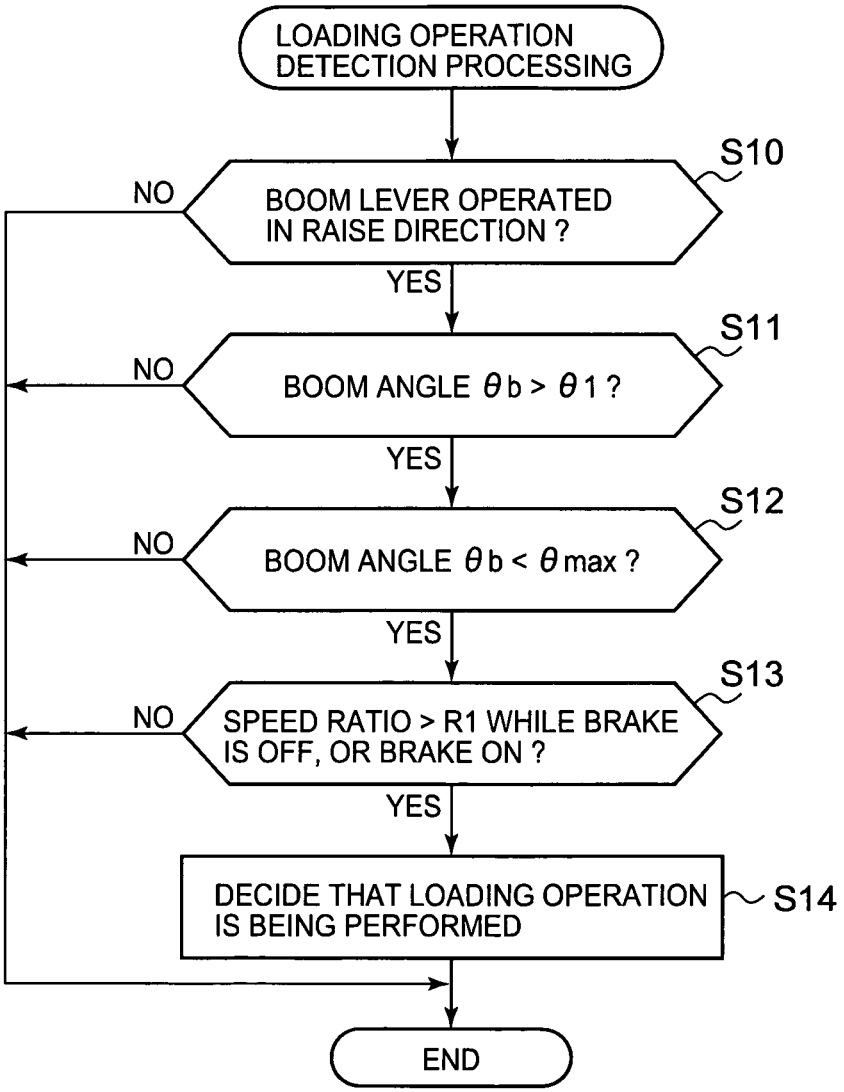
FIG. 9 is a flow chart for processing to detect loading operation.
Figure 10:
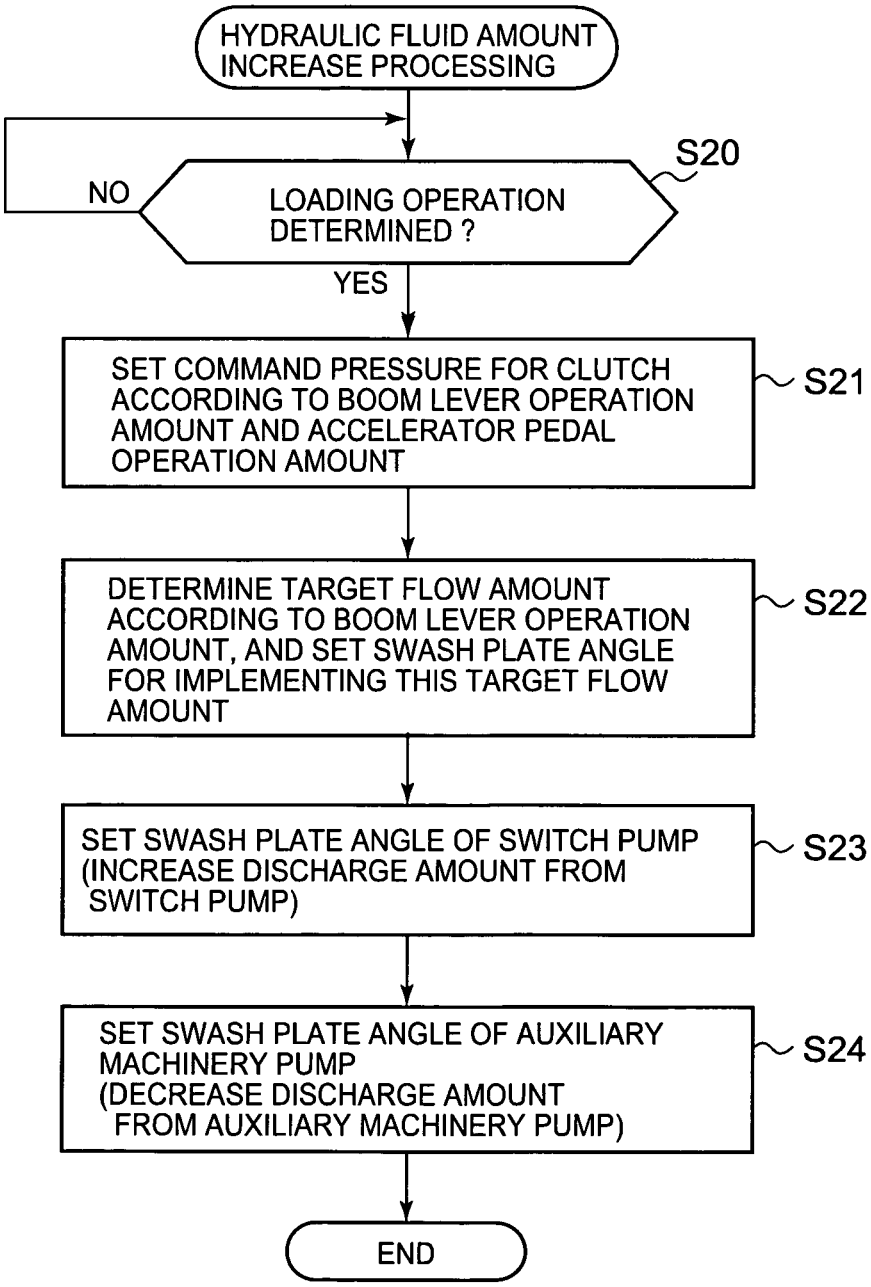
FIG. 10 is a flow chart for processing to increase the amount of hydraulic fluid supplied to the working apparatus.
Figure 11:
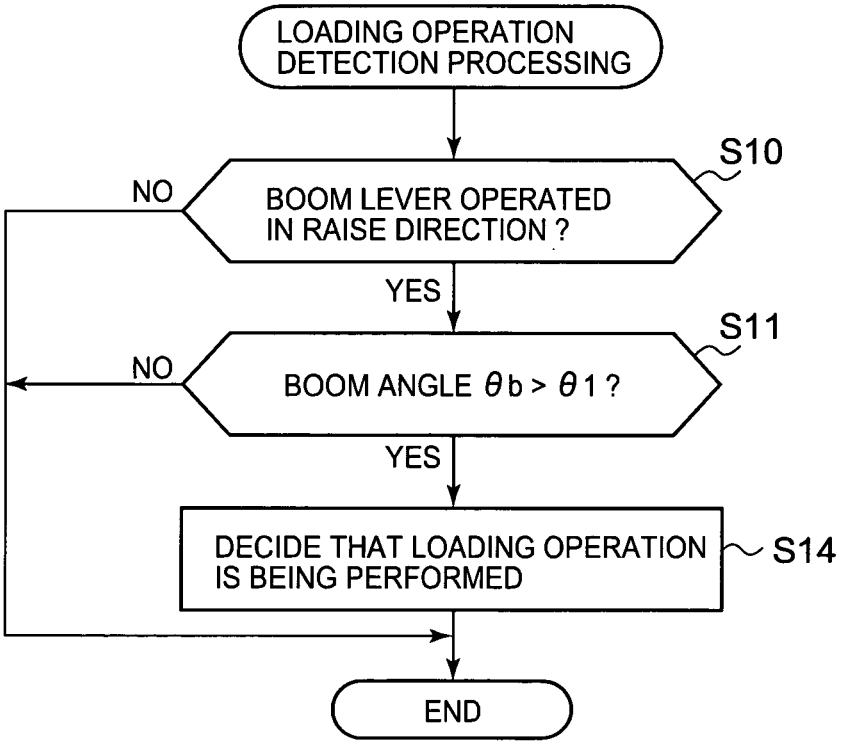
FIG. 11 is a flow chart for processing to detect loading operation, according to a second embodiment.
Figure 12:
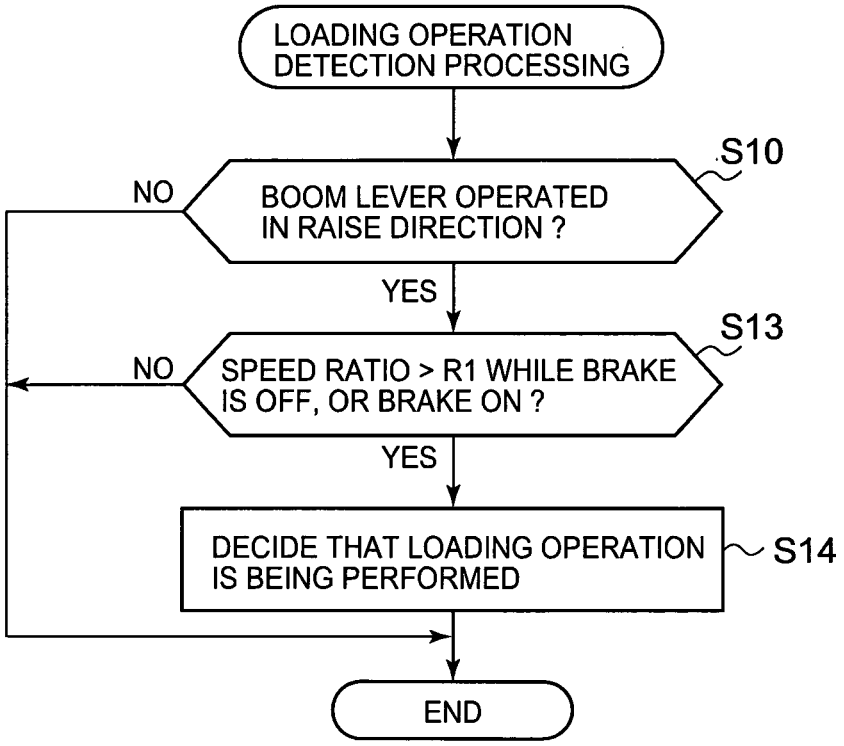
FIG. 12 is a flow chart for processing to detect loading operation, according to a third embodiment.
Figure 13:
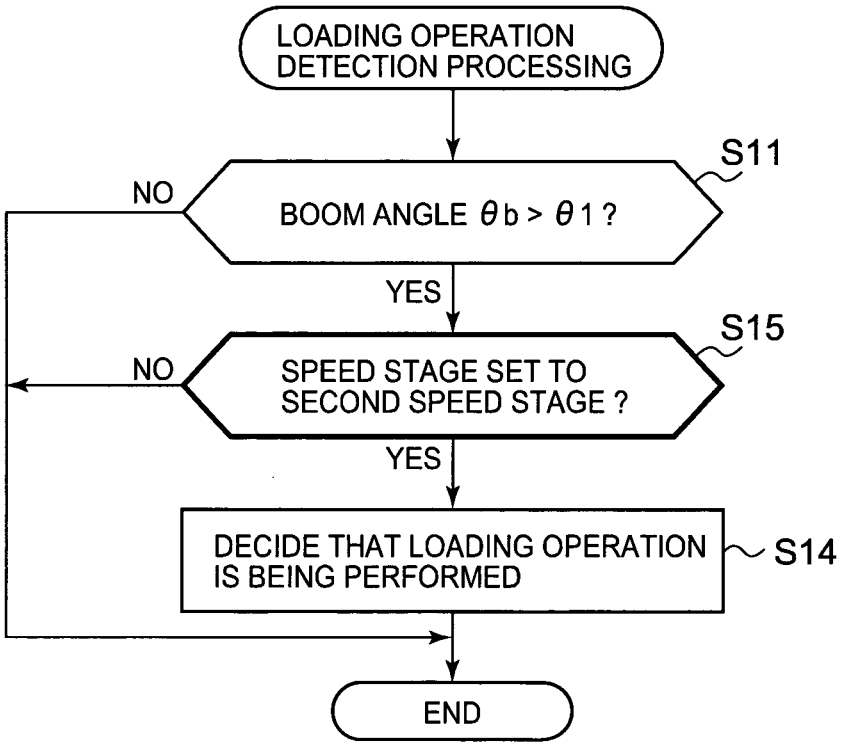
FIG. 13 is a flow chart for processing to detect loading operation, according to a fourth embodiment.
Figure 14:
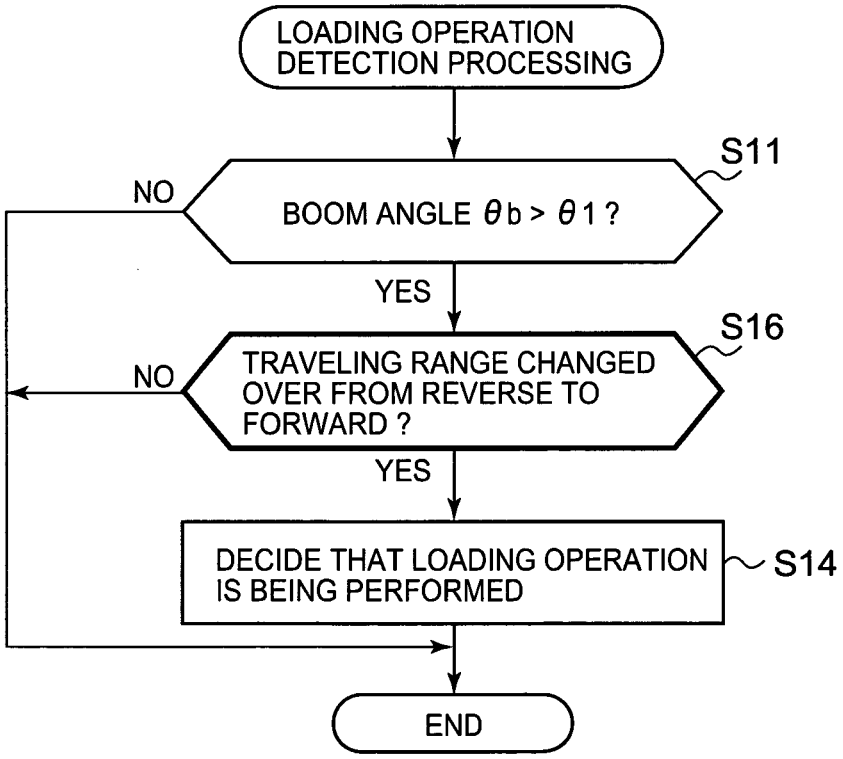
FIG. 14 is a flow chart for processing to detect loading operation, according to a fifth embodiment.
Figure 15:
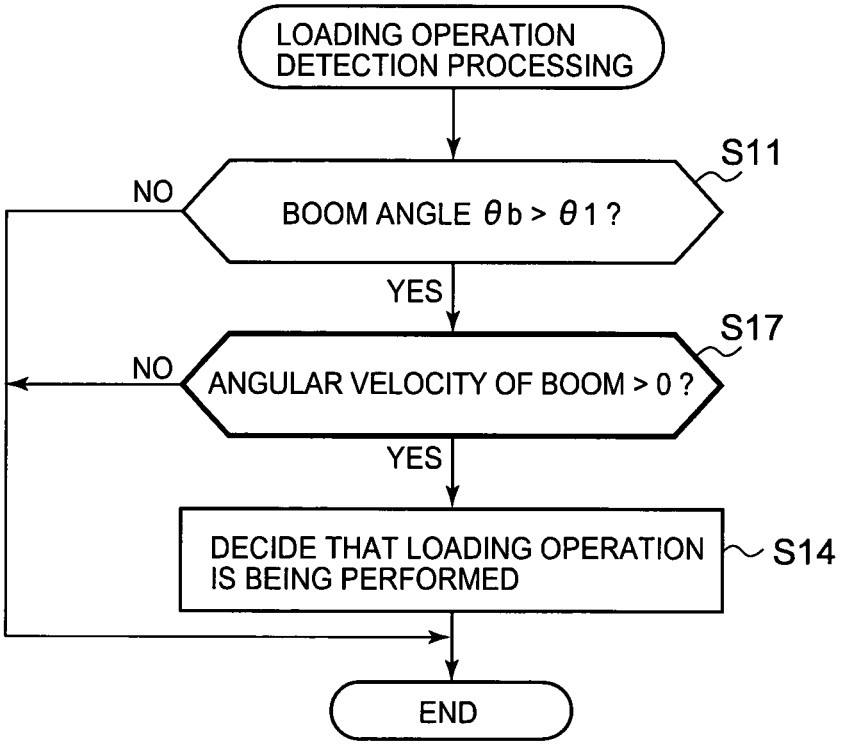
FIG. 15 is a flow chart for processing to detect loading operation, according to a sixth embodiment.
Figure 16:
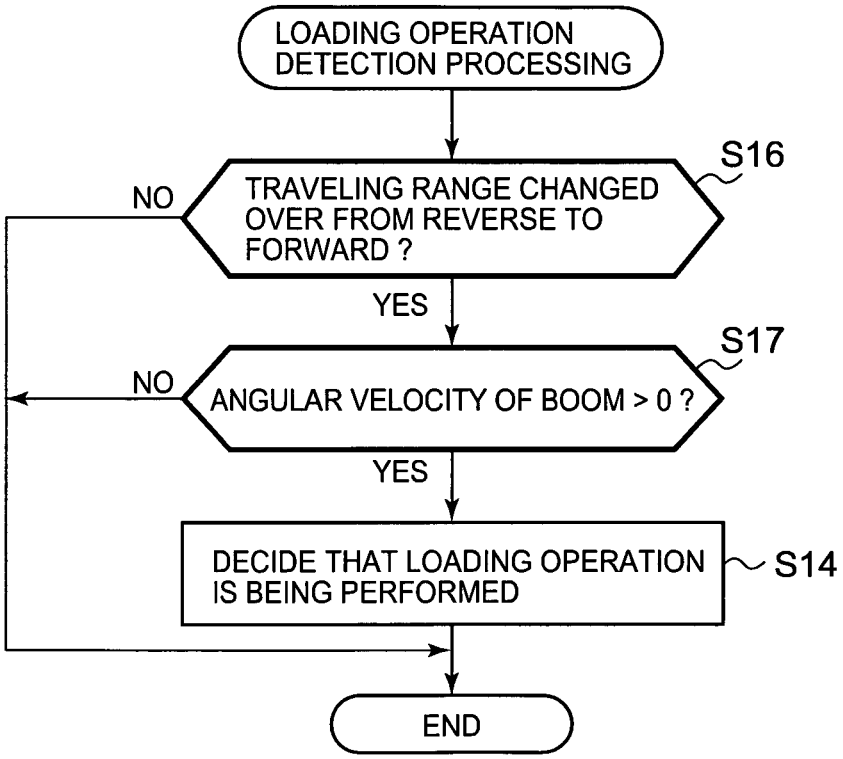
FIG. 16 is a flow chart for processing to detect loading operation, according to a seventh embodiment.
Figure 17:
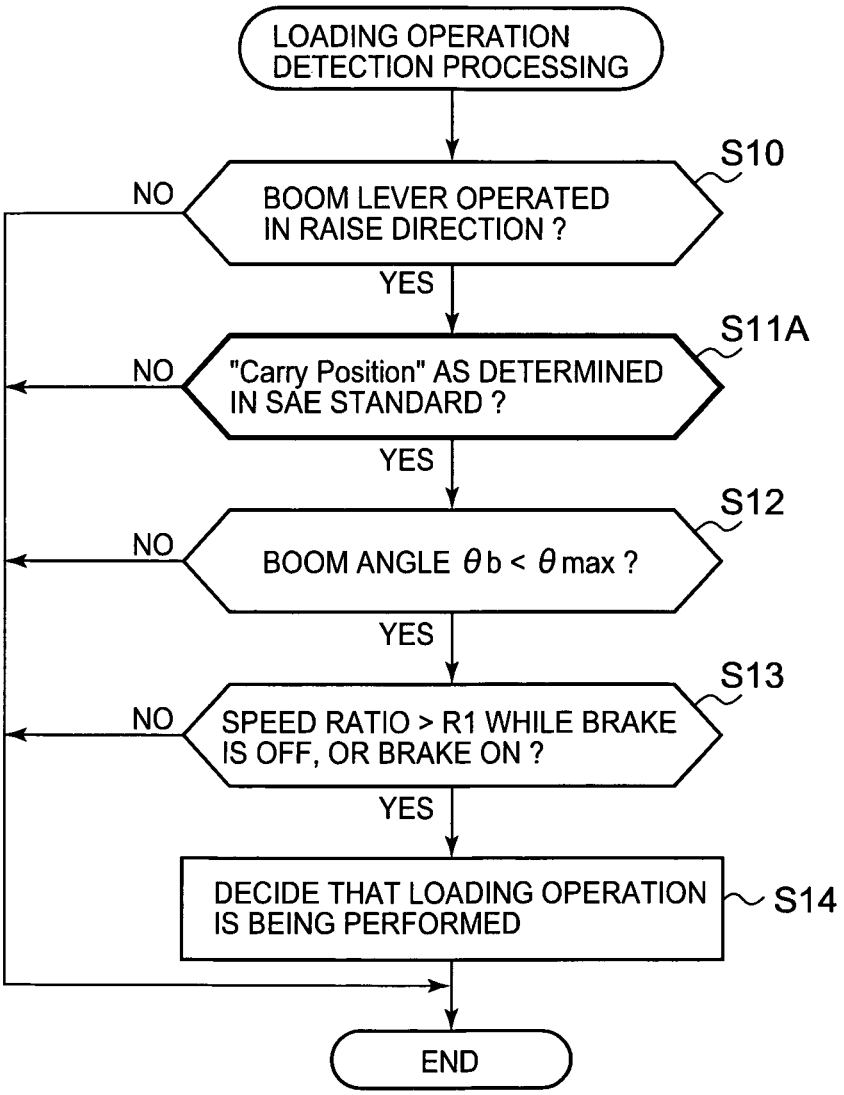
FIG. 17 is a flow chart for processing to detect loading operation, according to an eighth embodiment.
Figure 18:
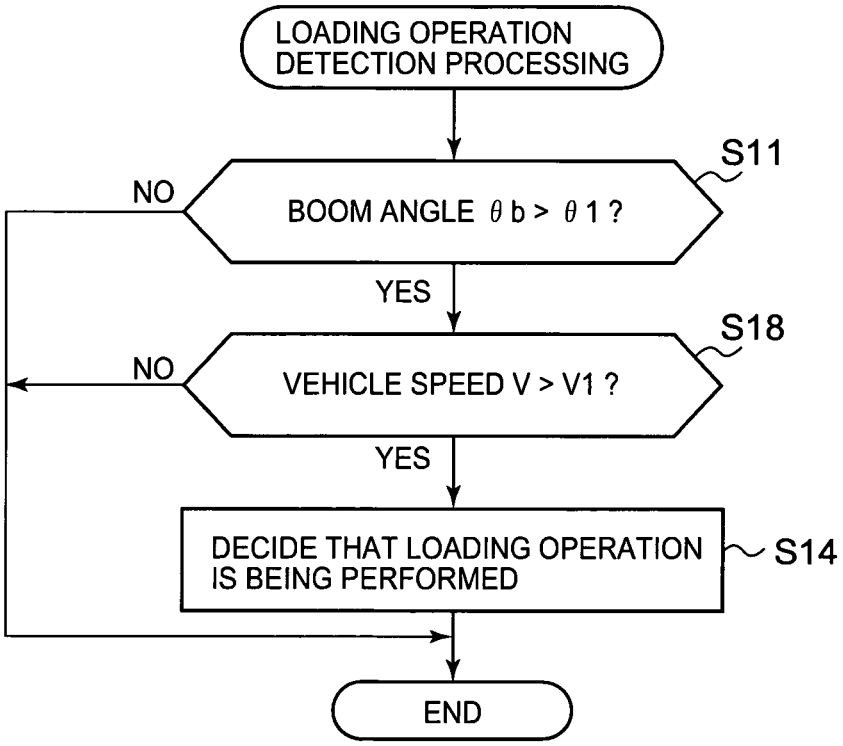
FIG. 18 is a flow chart for processing to detect loading operation, according to a ninth embodiment.

1: wheel loader, 2: vehicle body, 3: tires, 4: engine room, 5: working apparatus, 6: operator compartment, 10: dump truck, 11: subject of excavation, 21: rear vehicle body portion, 22: front vehicle body portion, 23: link portion, 51: boom, 52: bucket, 100: mechanical structure, 101: engine, 102: output splitter, 103: traveling system, 104: hydraulic system, 110: clutch, 111: torque converter, 112: transmission, 113: axle, 120: loader pump, 121: switch pump, 122: steering pump, 123: main valve, 124: load sensing valve, 125: bucket lever, 126: boom lever, 127: steering lever, 128: boom cylinder, 129: bucket cylinder, 130: steering cylinder, 131: auxiliary machinery pump, 132: auxiliary machinery, 140: sensors of various types, 141: traveling range sensor, 142: boom lever operation amount sensor, 143: boom angle sensor, 144: engine rotational speed sensor, 145: clutch output rotational speed sensor, 146: transmission output rotational speed sensor, 147: brake pedal operation amount sensor, 148: accelerator pedal operation amount sensor, 149: vehicle speed meter, 200: controller, 210: calculation unit, 211: working detection means, 212: hydraulic fluid amount increase control means, 212: hydraulic fluid amount increase control means, 212A: swash plate command signal control means, 212B: clutch command pressure control means, 220: memory, 221: program, 222: parameters, 223: tables, 230: input and output interface unit.

What is claimed is:

1. A working vehicle in which an output from an engine is distributed via a splitter to each of a traveling system and a hydraulic system, the working vehicle comprising:

said traveling system including a clutch connected to said engine via said splitter, a transmission which transmits drive force outputted from said clutch to drive wheels according to a set speed stage, and a vehicle speed detection means; and said hydraulic system including a plurality of pumps driven via said splitter, a boom rotatably provided to one end of a vehicle body, a bucket rotatably provided to one end of said boom, a boom cylinder for rotating said boom, a bucket cylinder for rotating said bucket, a first control valve which supplies hydraulic fluid discharged from a first pump included in said pumps to said boom cylinder and to said bucket cylinder, according to operation amounts of a boom lever and a bucket lever, and a second pump included in said pumps and being capable of supplying hydraulic fluid to said boom cylinder via said first control valve;

an operational state detection means which detects a loading operation state of the working vehicle; and a hydraulic fluid amount increase control means which increases a flow amount of hydraulic fluid supplied to said boom cylinder when said operation state detecting means detects a loading operation is being performed with said boom and said bucket.

2. The working vehicle according to claim 1, wherein said operational state detection means performs said detection as to whether or not said loading operation is being performed, on the basis of at least two parameters among: the operation amount of said boom lever; an angle of said boom; a speed stage to which said transmission is set; a vehicle speed detected by said vehicle speed detection means; a traveling range to which said transmission is set; and a speed of extension of said boom cylinder.

3. The working vehicle according to claim 1, wherein said operational state detection means detects that said loading operation is being performed by said boom and said bucket, if at least two of the following conditions are satisfied:

(a) said boom lever is being operated so as to raise said boom;

(b) the angle of said boom is greater than or equal to a predetermined angle which is set in advance;

(c) the angle of said boom is less than a maximum angle which is set in advance;

(d) the ratio between an output rotational speed and an input of the rotational speed of said clutch is greater than or equal to a predetermined value which is set in advance;

(e) the speed stage set for said transmission is the same as a predetermined speed stage which is set in advance;

(f) the traveling range set for said transmission has been changed over from reverse to forward;

(g) the speed of extension of said boom cylinder is positive; and (h) the vehicle speed detected by said vehicle speed detection means is greater than or equal to a predetermined speed which is set in advance.

4. The working vehicle according to claim 1, wherein said hydraulic fluid amount increase control means increases the flow amount of hydraulic, fluid supplied to said boom cylinder by decreasing a clutch pressure commanded for said clutch.

5. The working vehicle according to claim 1, wherein said hydraulic fluid amount increase control means increases the flow amount of hydraulic fluid supplied to said boom cylinder by increasing the flow amount of hydraulic fluid discharged from said first pump.

6. The working vehicle according to claim 1, wherein said hydraulic fluid amount increase control means increases the flow amount of hydraulic fluid supplied to said boom cylinder by supplying hydraulic fluid to said boom cylinder from said second pump, in addition to the hydraulic fluid discharged from said first pump.

7. The working vehicle according to claim 1, wherein said hydraulic fluid amount increase control means increases the flow amount of hydraulic fluid supplied to said boom cylinder by decreasing a clutch pressure commanded for said clutch, and by supplying hydraulic fluid to said boom cylinder from said second pump, in addition to the hydraulic fluid discharged from said first pump.

8. The working vehicle according to claim 1, wherein:

said operational state detection means detects that said loading operation is being performed by said boom and said bucket, if: said boom lever is being operated so as to raise said boom; an angle of said boom is at least equal to a predetermined angle which is set in advance; the angle of said boom is less than a maximum angle which is set in advance; and also when a brake is off, a ratio between an output rotational speed and an input of the rotational speed of said clutch is greater than or equal to a predetermined value which is set in advance; and said hydraulic fluid amount increase control means increases the flow amount of hydraulic fluid supplied to said boom cylinder by decreasing a clutch pressure commanded for said clutch.

9. A working vehicle in which an output from an engine is distributed via a splitter to each of a traveling system and a hydraulic system, the working vehicle comprising:

said traveling system including a clutch connected to said engine via said splitter, a transmission which transmits drive force outputted from said clutch to drive wheels according to a set speed stage, and a vehicle speed detection means; and said hydraulic system including a plurality of pumps driven via said splitter, a boom rotatably provided to one end of a vehicle body, a bucket rotatably provided to one end of said boom, a boom cylinder for rotating said boom, a bucket cylinder for rotating said bucket, a first control valve which supplies hydraulic fluid discharged from a first pump included in said pumps to said boom cylinder and to said bucket cylinder, according to operation amounts of a boom lever and a bucket lever, and a second pump included in said pumps and being capable of supplying hydraulic fluid to said boom cylinder via said first control valve;

an operational state detection means which detects a loading operation is being performed by said boom and said bucket, if: said boom lever is being operated so as to raise said boom; an angle of said boom is at least equal to a predetermined angle which is set in advance; the angle of said boom is less than a maximum angle which is set in advance; and also a ratio between an output rotational speed and an input of the rotation speed of said clutch is greater than or equal to a predetermined value which is set in advance; and a hydraulic fluid amount increase control means which increases a flow amount of hydraulic fluid supplied to said boom cylinder, upon said detection of said loading operation.

10. The working vehicle according to claim 9, wherein said operational state detection means detects that said loading operation is being performed by said boom and said bucket, if at least two of the following conditions is satisfied:

(a) said boom lever is being operated so as to raise said boom;

(b) the angle of said boom is greater than or equal to a predetermined angle which is set in advance;

(c) the angle of said boom is less than a maximum angle which is set in advance;

(d) the ratio between an output rotational speed and an input of the rotational speed of the clutch is greater than or equal to a predetermined value which is set in advance;

(e) the speed stage set for said transmission is the same as a predetei wined speed stage which is set in advance;

(f) the traveling range set for said transmission has been changed over from reverse to forward;

(g) the speed of extension of said boom cylinder is positive; and (h) the vehicle speed detected by said vehicle speed detection means is greater than or equal to a predetermined speed which is set in advance.

11. The working vehicle according to claim 9, wherein said hydraulic fluid amount increase control means increases the flow amount of hydraulic fluid supplied to said boom cylinder by decreasing a clutch pressure commanded for said clutch.

12. The working vehicle according to claim 9, wherein said hydraulic fluid amount increase control means increases the flow amount of hydraulic fluid supplied to said boom cylinder by increasing the flow amount of hydraulic fluid discharged from said first pump.

13. The working vehicle according to claim 9, wherein said hydraulic fluid amount increase control means increases the flow amount of hydraulic fluid supplied to said boom cylinder by supplying hydraulic fluid to said boom cylinder from said second pump, in addition to the hydraulic fluid discharged from said first pump.

14. The working vehicle according to claim 9, wherein said hydraulic fluid amount increase control means increases the flow amount of hydraulic fluid supplied to said boom cylinder by decreasing a clutch pressure commanded for said clutch, and by supplying hydraulic fluid to said boom cylinder from said second pump, in addition to the hydraulic fluid discharged from said first pump.

15. A hydraulic fluid amount control method for use in a working vehicle which distributes as output from an engine via a splitter to each of a traveling system and a hydraulic system, wherein:

said traveling system comprises: a clutch connected to said engine via said splitter, and a tra omission which transmits drive force outputted from said clutch to drive wheels according to a set speed stage; and said hydraulic system comprises: a plurality of pumps driven via said splitter, a boom rotatably provided to one end of a vehicle body, a bucket rotatably provided to one end of said boom, a boom cylinder for rotating said boom, a bucket cylinder for rotating said bucket, a first control valve which supplies hydraulic fluid discharged from a first pump included in said pumps to said boom cylinder and to said bucket cylinder, according to operation amounts of a boom lever and a bucket lever, and a second pump included in said pumps and being capable of supplying hydraulic fluid to said boom cylinder via said first control valve, the method comprising:

processing in which it is determined whether or not a loading operation is being performed by the working vehicle; and processing in which, if said loading operation has been detected as being performed with boom and said bucket, a flow amount of hydraulic fluid supplied to said boom cylinder is increased.

* * * * *